US008339900B2

(12) United States Patent
Müller et al.

(10) Patent No.: US 8,339,900 B2
(45) Date of Patent: Dec. 25, 2012

(54) WATCH WITH TIME ZONE DISPLAY

(75) Inventors: Frank Müller, Dresden (DE); Peter Schmidt, Glashütte-Schlottwitz (DE)

(73) Assignee: Glashütter Uhrenbetrieb GmbH, Glashutte/Sachsen (DE)

( * ) Notice: Subject to any disclaimer, the term of this patent is extended or adjusted under 35 U.S.C. 154(b) by 270 days.

(21) Appl. No.: 12/936,066

(22) PCT Filed: Mar. 11, 2009

(86) PCT No.: PCT/EP2009/052873

§ 371 (c)(1), (2), (4) Date: Oct. 1, 2010

(87) PCT Pub. No.: WO2009/121699

PCT Pub. Date: Oct. 8, 2009

(65) Prior Publication Data

US 2011/0032802 A1 Feb. 10, 2011

(30) Foreign Application Priority Data

Apr. 2, 2008 (EP) ..... 08153983

(51) Int. Cl.
*G04B 19/22* (2006.01)
*G04B 19/24* (2006.01)

(52) U.S. Cl. ..... 368/21; 368/22; 368/27; 368/28

(58) Field of Classification Search ..... 368/21, 368/22, 27, 28, 34, 37, 187, 190
See application file for complete search history.

(56) References Cited

U.S. PATENT DOCUMENTS

| | | | | |
|---|---|---|---|---|
| 2,910,825 | A * | 11/1959 | Kirkwood | 368/21 |
| 3,633,354 | A | 1/1972 | Stemmler | |
| 3,675,411 | A * | 7/1972 | Sakuma | 368/27 |
| 4,717,260 | A | 1/1988 | Tsuji | |
| 5,195,062 | A * | 3/1993 | Masahiro et al. | 368/21 |
| 5,708,628 | A * | 1/1998 | Chen | 368/21 |
| 2008/0198696 | A1 | 8/2008 | Dias | |
| 2009/0016174 | A1 | 1/2009 | Schlencker et al. | |

FOREIGN PATENT DOCUMENTS

| | | | |
|---|---|---|---|
| CH | 563 608 | B5 | 6/1975 |
| DE | 298 10 245 | U1 | 11/1998 |
| DE | 10 2005 010 604 | B3 | 7/2006 |
| EP | 1 734 418 | A1 | 12/2006 |
| FR | 2 672 399 | A1 | 8/1992 |

* cited by examiner

*Primary Examiner* — Vit W Miska
(74) *Attorney, Agent, or Firm* — Sughrue Mion, PLLC

(57) ABSTRACT

The analogue display watch includes two separate time displays (40, 44) for first and second time zones, and a time zone indicator (50), which includes a place ring (53) associated with two apertures (51, 52) shifted angularly by $1/24^{th}$ of a revolution, and one of which is used in combination with winter time and the other with daylight saving time (DST). A first, manual, time-setting device (31) can simultaneously set the time of the first and second time displays (40, 44). A second, manual, time-setting device can rotate the second time display (44) and the time zone indicator (50) together, step-by-step, without changing the state of the first time display (40). A manual corrector (34, 63) rotates the place ring (53) step-by-step without changing the state of the first and second time displays (40, 44). The place symbols (54) are distributed over the circumference of the place ring (53) with a step of $1/96^{th}$ of a revolution, so as to include symbols (54*a*, 54*b*) representing time zones that differ from UTC by a non-integer number of hours. With these features, simple manipulations can display the time in any place in the world and time zone changes can be performed easily while taking account of daylight saving time and a change in hemisphere, where necessary.

10 Claims, 3 Drawing Sheets

WATCH WITH TIME ZONE DISPLAY

BACKGROUND OF THE INVENTION

The present invention concerns an analogue display watch with a first time display for a first time zone, associated with a first time-setting device, a second time display for a second time zone, associated with second, manual, time-setting means, and a time zone indicator including at least one index and a place ring for the places representing the time zones. The place ring rotates opposite said index, or vice-versa, the first, manual time-display means are able to set the time of the first and second time displays simultaneously, and the second time-setting means are able to rotate the second time display and the time zone indicator together, step by step, without changing the state of the first time display.

A description of a watch of this type can be found in U.S. Pat. No. 3,633,354 (=DE 1933049). In the version of FIGS. 1 and 2 of that patent, the time display includes four central hands, including a seconds hand and a minute hand, which are driven, as usual, by the watch movement. Via a conventional motion work, the cannon-pinion drives a 24-hour wheel carrying a first hour hand, for indicating, for example, the home time, on a 24-hour scale. To display the time of the second time zone, generally the local time, a second hour hand is secured to a 12 hour wheel, which is connected to the 24-hour wheel by a planetary gear, whose planetary wheel carrier carries the place ring that bears the city names appearing in turn in an aperture of the dial, to identify the second time zone. A conventional time-setting device with a stem and crown rotates the 24-hour wheel and 12 hour wheel simultaneously, and thus the two hour and minute hands. A second time-setting device, activated by a manual crown or push-buttons, moves the planetary wheel carrier by steps of $1/24^{th}$ of a revolution, and thus the place ring and simultaneously the 24 hour wheel and its hand.

With this construction, when the same time is displayed by both hour hands, it is always the same time zone (the original one) that is indicated by the place ring. If one wished the user to be able to change the original time zone, one would have to add a device for disconnecting the two hour hands. Moreover, with the concentric display of two different times, the user is liable to misread the display.

The change from winter time to daylight saving time and vice versa also raises a problem when this does not occur at the same time in both of the time zones concerned, since the time difference between the two time displays has to be specially altered, while keeping the same place indication. In particular, this problem arises each time that one of the two places considered is in the northern hemisphere and the other is in the southern hemisphere. Thus, for this reason too, it is desirable to have time-setting or correction means that offer greater freedom of manipulation, while allowing the usual manoeuvres to be carried out as simply as possible.

An additional problem with this type of watch is due to time zones whose time difference relative to coordinated universal time (UTC) is not an integer multiple of an hour. For example, the official time of some countries or territories is set with steps of a half-hour (for example in India, Iran, Newfoundland, Venezuela etc.), or a quarter-hour (Nepal), relative to the 24 conventional time zones. It is thus desirable to be able to indicate the time in such time zones using the second time display, without the user being forced to perform more complicated manipulations than for a conventional time zone. A rudimentary system was provided, in U.S. Pat. No. 4,717,260, which allows time differences of half an hour in a universal time watch, but it could not be used for a dial with two time displays.

Because of the aforementioned problems, it is only practical to use most current watches that display two time zones in some standard situations and it becomes too complicated in other cases.

SUMMARY OF THE INVENTION

It is an object of the present invention to create a watch that can display simultaneously and clearly two time zone times, while facilitating the manipulations required to change the time and/or time zone. It is a particular object to allow the user to take account of daylight saving time and winter time for each of the two places concerned, so that the correct time difference is introduced between the two time displays.

A watch is thus provided of the type indicated in the above preamble, characterized in that, in addition to the first and second time-setting devices, it includes a manual place corrector, which can rotate the place ring step by step without changing the state of the first and second time displays.

Thus, it is possible to change the time zone indication easily without changing the time displays, particularly when the two time displays are set to the same time. A significant practical consequence is that, from this position, after correcting the original time zone indication by using the place corrector if necessary, one just has to operate the second time-setting device until the time zone indicator indicates the desired second time zone, and the time of the second time zone will automatically be displayed.

According to a preferred embodiment of the invention, the time zone indicator includes two indexes, shifted angularly by $1/24^{th}$ of a revolution, such that when the symbol of a specific time zone is opposite the first of these indexes, the second time display indicates the normal or winter time, whereas when the same symbol is opposite the second index, the second time display indicates the daylight saving time of the same time zone, if appropriate. It is preferably the place ring that rotates, whereas said first and second indexes are apertures arranged in the dial used for the time displays. It will be seen below how the presence of two indexes or apertures easily solves the problems created by daylight saving time.

Other features and advantages of the invention will appear below in the description of a currently preferred embodiment, given by way of non-limiting example with reference to the annexed drawings.

DETAILED DESCRIPTION OF ONE EMBODIMENT

Figure 1:
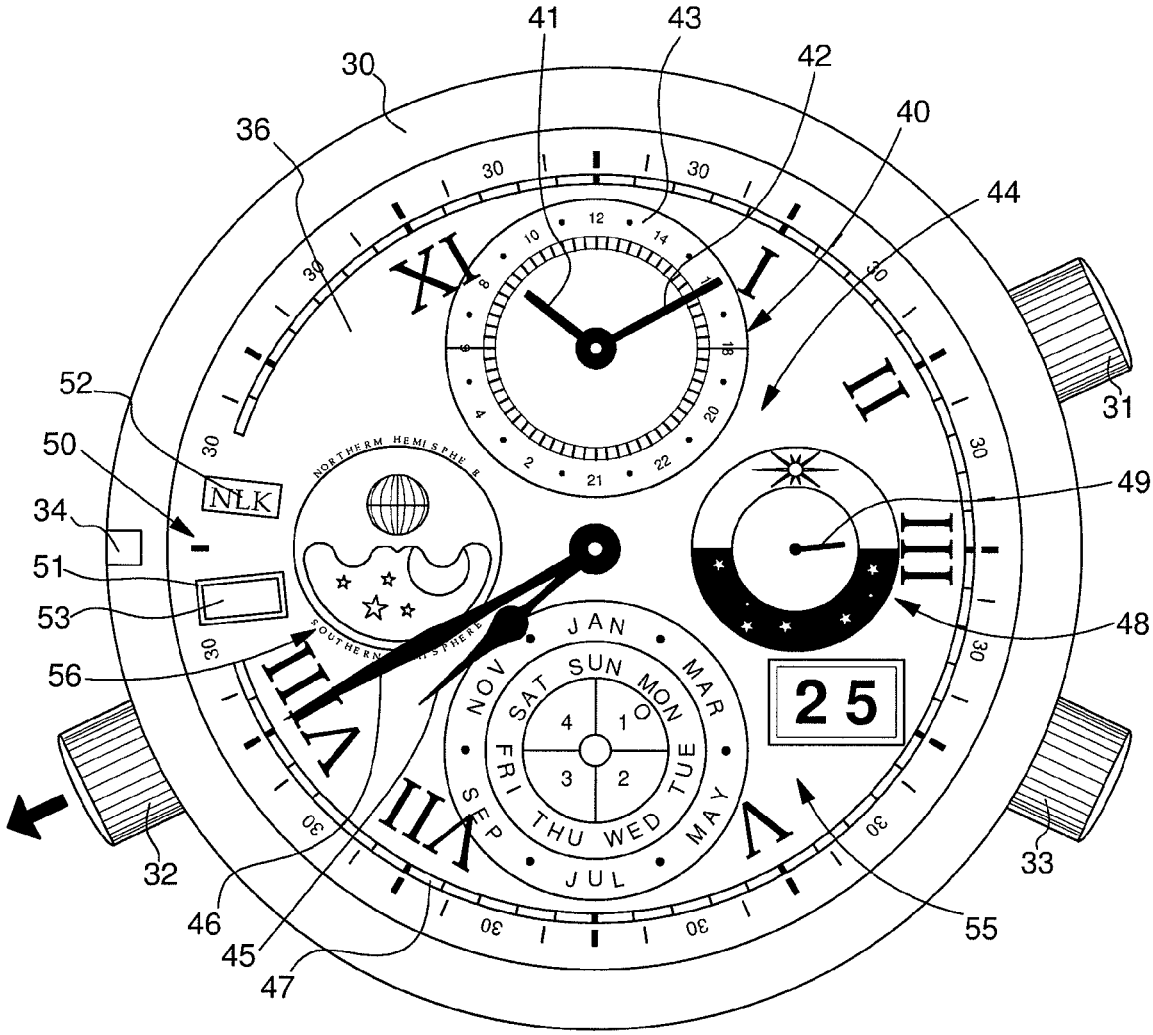
FIG. 1 is a schematic view of a wristwatch according to the invention, when it is displaying the time for two time zones that differ by eleven and a half hours.

Referring to FIG. 1, the watch shown includes a case 30 containing, in particular, the specific display members of the present invention. Manual control members, including two time-setting crowns 31 and 32, a date setting crown 33 and a place corrector push-button 34, are arranged on the periphery of the case. The top face of the watch has a dial 36 used for all the displays mentioned below. Other elements of the watch, which are not necessary to describe the present invention, are omitted from the drawings, for the sake of simplification.

In order to display the time of a first time zone, generally the home time of the watch user, a first time display 40 is provided, including a minute hand 42 and an hour hand 41, which completes one revolution in twenty-four hours opposite a corresponding hour circle 43, which is offset on dial 36. In order to display the time of a second time zone, generally the place where the user is located or going, a second time display 44 is provided, including a central minute hand 46 and a central hour hand 45, which completes one revolution in twelve hours, opposite a conventional hour circle 47 centred on dial 36, which is the usual display mode and thus enables the time to be read quickly and reliably. This second time display 44 further includes a day/night indicator 48 including, for example, a hand 49 coupled to hand 46 by a gear so as to complete one revolution in twenty-four hours. The watch movement, housed in case 30, drives the two time displays 40 and 44. This movement could also drive a seconds hand, added to one or other of the time displays.

Figure 2:
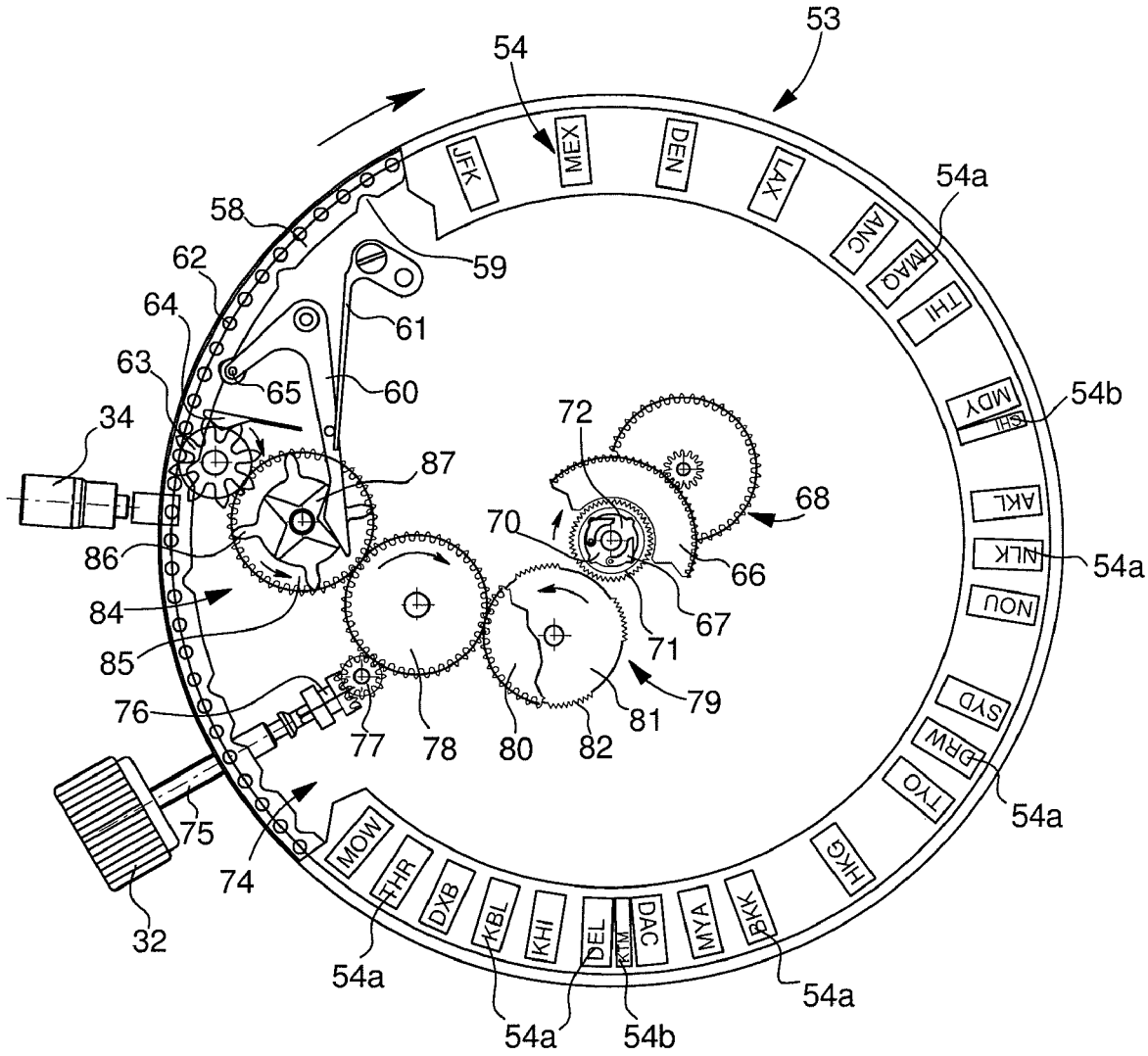
FIG. 2 is a plan view in partial cross-section of the place disc, associated with a place corrector and a time-setting device in the watch of FIG. 1.

A time zone indicator 50 has two apertures 51 and 52 arranged in dial 36 and angularly shifted by $1/24^{th}$ of a revolution relative to the centre of the dial, to reveal two sectors, which are also shifted, on a rotating place ring 53, shown in part in FIG. 2 and carrying a circular row of symbols 54 each representing one of the time zones currently used in the world. The first aperture 51 is used in combination with the standard time display of a time zone, which is also the winter time of said time zone if daylight saving time exists in the territory concerned. In this latter case, the second aperture 52 is used in combination with the daylight saving time display (DST) as will be seen below.

Moreover, the watch includes a calendar display 55 and a moon phase indicator 56, which do not form part of the invention described here, but the date indication can give useful information in combination with one of the time displays and the time zone indicator.

Figure 4:
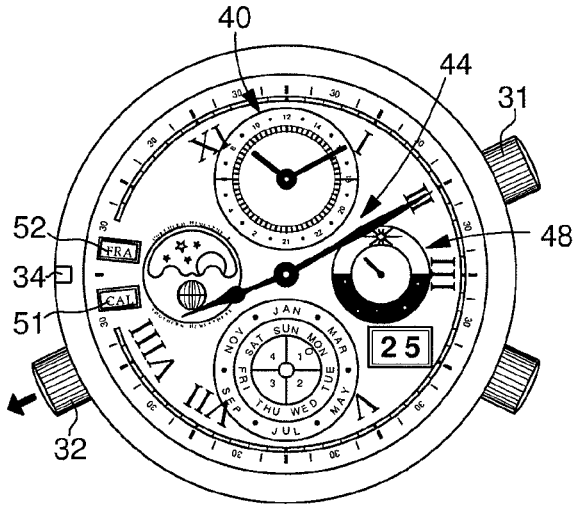

Referring to FIG. 2, the place symbols 54 on place ring 53 include twenty-four main symbols, spaced from each other at an angle of 15°, representing a time difference of one hour. In accordance with usual practice, the symbols 54 are formed here of three letters forming a well known place code (city, airport, island), characterizing the situation of the time zone in the world. For example, LAX is the IATA code for Los Angeles International Airport. Additional symbols 54*a* are inserted between the main symbols, spaced at an angle of 7.5° relative to the main symbols, to represent the intermediate time zones in which the time difference relative to UTC is a half-hour plus an integer number of hours. Among these additional symbols 54*a*, those seen in FIG. 4 represent the respective time zones of Iran (THR), Afghanistan (KBL), India (DEL), Myanmar (MYA), central Australia (DRW), Norfolk Island (NLK) and the Marquise islands (MAQ). Further, other additional symbols 54*b* are inserted between the main symbols, spaced at an angle of 3.75° relative to said main symbols, to represent intermediate time zones in which the difference of the legal time relative to UTC is an integer number of hours plus a quarter or three quarters of an hour. These additional symbols 54*b* include, shown in FIG. 4, those representing the time zone of Nepal (KTM), which is UTC−5:45 and the time zone of the Chatham islands (CHI), which is UTC+12:45.

In order to hold place ring 53 snapped into all the respective positions that symbols 54 (including 54*a* and 54*b*) can take opposite apertures 51 and 52, a support 58, incorporated in ring 53, is provided with notches 59 in which a roller 65 of a jumper spring 60 can engage, pushed by a spring 61. Support 58 further includes a toothing 62 with ninety-six teeth, for rotating ring 53 by steps of 3.75° corresponding to a time difference of a quarter of an hour, this step also being the modulus for the spaces between symbols 54 and between notches 59. A pinion 63 with eight teeth, retained slightly by a jumper-spring 64, is permanently engaged in toothing 62 and can pivot one step at a time via the action of corrector push-button 34 mentioned with reference to FIG. 1. Thus, repeated pressure on this push-button allows the user to rotate place ring 53 manually to make the desired symbol 54 appear in any of apertures 51 and 52.

FIG. 2 shows the conventional elements of second time display 44, namely hour wheel 66, minute wheel 67 and motion work 68 connecting said two wheels. In the present case, these elements are driven from the movement by means of a minute wheel set 70 coupled to the gear train of first time display 40 and provided with spring pawls 71 that can snap into notches 72 of wheel 67. The angular step between notches 72 corresponds to the smallest fraction of an hour between the time zones indicated by ring 53, and therefore a quarter of an hour in the present case, which corresponds to a quarter of a revolution of wheel 67. It will be noted that the action of setting the time of first time display 40 causes minute wheel set 70, and with it wheel 67, to rotate, and this thus also simultaneously sets the time of second time display 44.

FIG. 2 further shows a second manual time-setting device 74, which the user activates manually via crown 32, which is secured to a control stem 75 of conventional design, with a sliding pinion 76 that meshes with a time-setting pinion 77 when crown 32 is pulled. Pinion 77 drives an intermediate wheel 78, which is meshed with an intermittent movement mechanism 79, including a wheel 80 secured to a switching wheel 81. The periphery of switching wheel 81 has four toothed sectors 82, which each include a quarter of the number of teeth of minute wheel 67, so as to be driven by said minute wheel in stages of a quarter of an hour. When the time of the second time display is being set, wheel set 70 is retained by the first time display, such that notches 72 move relative to pawls 71 and are engaged at each quarter hour of time difference.

Moreover, intermediate wheel 78 is connected to pinion 63 by a second intermittent movement mechanism 84 that has a wheel 85 permanently meshed with wheel 78. A switching wheel 86, with four spaced teeth for intermittently driving pinion 63, and a star-wheel 87, with four branches, are secured to wheel 85. Jumper-spring 60 cooperates with star-wheel 87 to generate two effects when its roller 65 engages in one of the notches of place ring 53: it gives crown 32 the sensation of clicking into place each time that a place symbol 54 is opposite one of apertures 51 and 52, and it also holds device 74 in stop positions where intermittent movement mechanism 79 and 84 are uncoupled from driven members 67 and 63 and therefore prevent said members 67 and 63 from driving intermediate wheel 78 and thus the other member. This is due to the fact that, in the four stop positions determined by jumper-spring 60, the teeth of wheel 86 remain out of reach of the teeth of pinion 63, just as toothed sectors 83 remain out of reach of the toothing of minute wheel 67. In other words, each of the two intermittent movement mechanisms only transmits movement from crown 32 and intermediate wheel 78. Because of this uncoupling, activation of push-button 34 does not alter time displays 44 and 40, and the joint time-setting of the two time displays by means of first crown 32 changes nothing in time zone indicator 50.

The time-setting manoeuvres on the watch described above are as follows. Referring to FIGS. 3 to 6, we will start from an initial situation where the display has to be adjusted to two new time zones.

Figure 3:
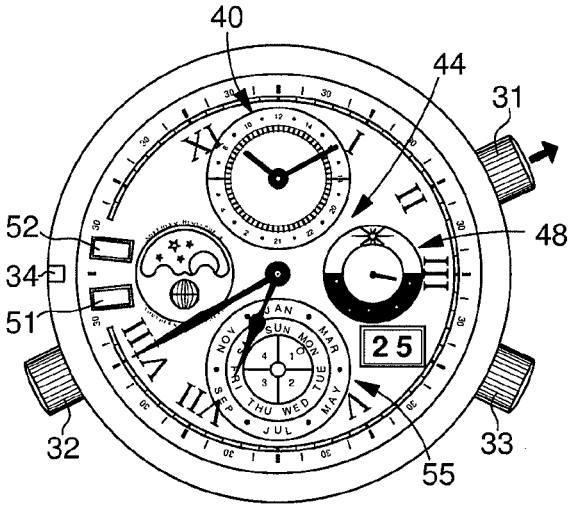
FIGS. 3 to 6 shows different states of the display during manoeuvres performed on the watch of FIG. 1.

The action of rotating crown 31 into a pulled out position activates a time-setting mechanism similar to that of an ordinary watch, for setting first time display 40 to the home time, for example 8:10 according to FIG. 3. In the watch according to the invention, said mechanism acts in the same way on second time display 44, which will take a position that depends upon its initial state. Crown 31 can then be pushed back in again.

The action of pulling out crown 32 and rotating it in one direction or the other causes second time display 44 and place ring 53 to rotate at the same time and one can feel the change from one notch 59 to another each time that a time zone symbol 54 arrives exactly opposite one of apertures 51 and 52. For this initial adjustment, second time display 44 will be set to the same time as the first time display, taking account of day/night indicator 48, which gives the state shown in FIG. 4.

Figure 5:
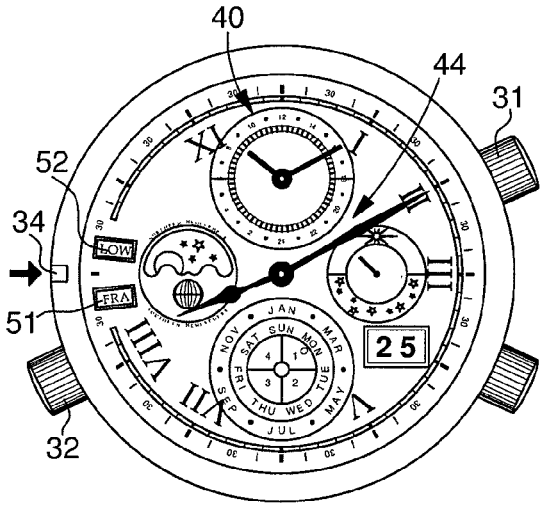
Figure 6:
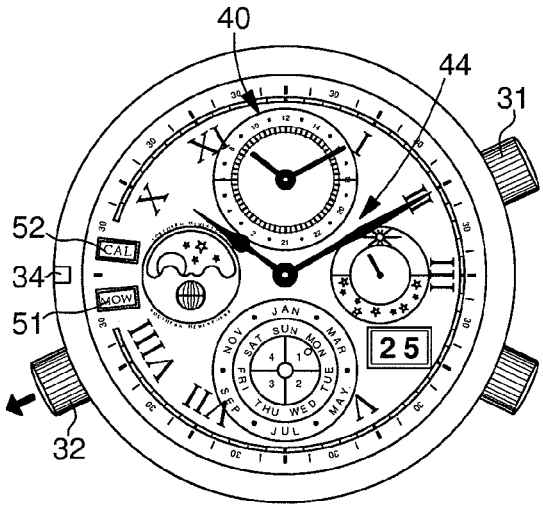

Place ring 53 then has to be rotated by repeatedly pressing on push-button 34 until the home time zone symbol 54 (here FRA for Frankfurt) is in place in one of the apertures, namely top aperture 52 when it is daylight saving time and bottom aperture 51 when it is winter or normal time, as is the case in FIG. 5. Second time display 44 has not rotated.

Let us assume that the person wearing the watch travels to a country in the same time zone as Moscow (MOW). By pulling out crown 32 and rotating it in the direction corresponding to the east, the user moves second time display 44 and place ring 53 forward together to bring the symbol MOW into top aperture 52, if daylight saving time currently applies in the destination country, or otherwise into bottom aperture 51, as is the case in FIG. 6. Display 44 has moved forward exactly two hours in this case. However, the example of FIG. 1 shows a similar operation when the traveller goes to Norfolk Island, located in the southern hemisphere. It is assumed that daylight saving time applies. The corresponding symbol NLK must thus be brought into top aperture 52. The second time display indicates 19:40, the time difference with winter time in central Europe (time zone FRA) being then 10 hours 30 minutes plus 1 hour for daylight saving time in Norfolk Island.

From the above description, those skilled in the art will understand that this time zone watch is both polyvalent and easy to use. The use of two separate time displays 40 and 44 each having two hands means that the time can be read precisely and unambiguously. The manual control means can display the time in any place in the world by simple manipulations, and time zone changes can be performed taking account of daylight saving time and changes in hemisphere, where necessary.

The invention claimed is:

1. An analogue display watch including a first time display for a first time zone, associated with a first time-setting device, a second time display for a second time zone, associated with a second, manual, time-setting device, and a time zone indicator including at least one index and a place ring provided with place symbols, which represent time zones, the place ring rotating opposite said index or vice-versa, the first, manual, time-setting device being able to set the time of the first and second time displays simultaneously, and the second time-setting device being able to rotate the second time display and the time zone indicator together, step-by-step, without changing the state of the first time display, wherein it further includes a manual place corrector, able to rotate the place ring step by step, without changing the state of the first and second time displays and wherein said second time display includes hour and minute hands.

2. The watch according to claim 1, wherein the axis of rotation of the second time display is at the centre of the dial, whereas the first time display has hour and minute hands, whose axis of rotation is offset on the dial.

3. The watch according to claim 2, wherein the hour hand of the second time display completes one revolution in twelve hours.

4. The watch according to claim 3, wherein the second time display also has a day/night indicator.

5. The watch according to claim 1, wherein the time zone indicator has two indexes, shifted angularly by $1/24^{th}$ of a revolution, such that when the symbol of a determined place is opposite a first of said indexes, the second time display indicates the second or winter time, whereas when said symbol is opposite the said second index, the second time display indicates the daylight saving time of the same place, where necessary.

6. The watch according to claim 5, wherein the place ring can rotate and said indexes are apertures arranged in a dial to each reveal one place symbol at a time.

7. The watch according to claim 5, wherein the place symbols are distributed over the circumference of the place ring with a smaller step than $1/24^{th}$ of a revolution, in particular $1/96^{th}$ of a revolution, so as to include symbols representing time zones that differ by a non-integer number of hours relative to UTC.

8. The watch according to claim 6, wherein the place ring includes a series of notches, distributed over the circumference thereof so as to correspond to all the possible positions of the place symbols opposite the apertures, and wherein a jumper-spring engages in said notches, in succession, and cooperates with the second, manual, time-setting device so that the user can feel the change from one notch to another during the time-setting operation.

9. The watch according to claim 1, wherein the second, manual, time-setting means include an intermediate wheel driven in rotation from a manual control crown, said wheel being respectively connected to the second time display via a first intermittent movement mechanism and to the time zone indicator, via a second intermittent movement mechanism, said intermittent movement mechanisms preventing the intermediate wheel from being driven from the second time display or the time zone indicator.

10. The watch according to claim 7, wherein said intermittent movement mechanisms produce intermittent movements that each correspond to a time difference of a quarter of an hour.

* * * * *